United States Patent [19]

Bradford

[11] Patent Number: 4,517,627

[45] Date of Patent: May 14, 1985

[54] SPOT LIGHT FOR HANDBAG AND LIKE RECEPTACLES

[76] Inventor: Herbert G. Bradford, 290 Silverstone Dr., Apt. 93, Rexdale, Ontario M9V 3J4, Canada

[21] Appl. No.: 621,116

[22] Filed: Jun. 15, 1984

[51] Int. Cl.[3] ..... A45C 14/06

[52] U.S. Cl. ..... 362/156; 200/60; 362/154; 362/191; 362/200; 362/205; 362/295; 362/310; 362/368; 362/427

[58] Field of Search ..... 362/156, 154, 191, 200, 362/205, 295, 310, 368, 427; 200/60

[56] References Cited

U.S. PATENT DOCUMENTS

| | | | |
|---|---|---|---|
| 2,179,214 | 11/1939 | Hallbauer | 362/156 |
| 2,179,777 | 11/1939 | Davis | 177/329 |
| 2,304,387 | 12/1942 | Whiting et al. | 240/6.45 |
| 2,400,974 | 5/1946 | Berman | 240/6.45 |
| 2,558,606 | 6/1951 | Crockett | 362/156 |
| 2,866,083 | 12/1958 | Lima, Jr. | 240/10.67 |
| 3,046,389 | 7/1962 | Catelli et al. | 240/10.65 |
| 3,408,489 | 10/1968 | Boyer et al. | 362/156 |
| 4,091,443 | 5/1978 | Ohrenstein et al. | 362/156 |
| 4,181,928 | 1/1980 | Zelina | 362/184 |
| 4,332,007 | 5/1982 | Gibstein et al. | 362/156 X |
| 4,423,473 | 12/1983 | Kirkley | 362/186 |

*Primary Examiner*—Stephen J. Lechert, Jr.
*Attorney, Agent, or Firm*—Ridout & Maybee

[57] ABSTRACT

A spot light which can be made very compactly for use in handbags or like receptacles is provided with a dry cell extending adjacent one edge wall of a housing, and a lamp bulb disposed in an opening in an end wall of the housing adjacent the opposite edge wall. A rear wall of the housing is provided with a pivotal connection for attaching the light to an upper corner of the inside wall of the receptacle, so that the light is readily accessible and can be rotated about its pivot to illuminate substantially the entire contents of the receptacle with a relatively bright concentrated spot of light. The pivotal connection offers frictional or other resistance to rotation, so that once adjusted, the light is retained stably in a selected position while the user retrieves a selected illuminated item from the receptacle.

9 Claims, 4 Drawing Figures

FIG 1
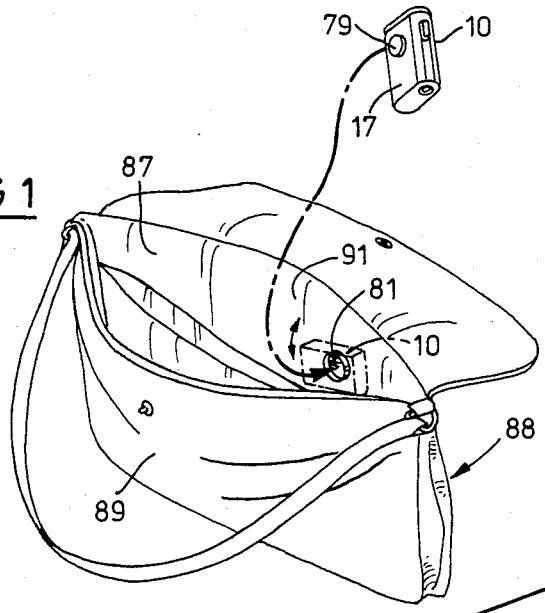
FIG. 2
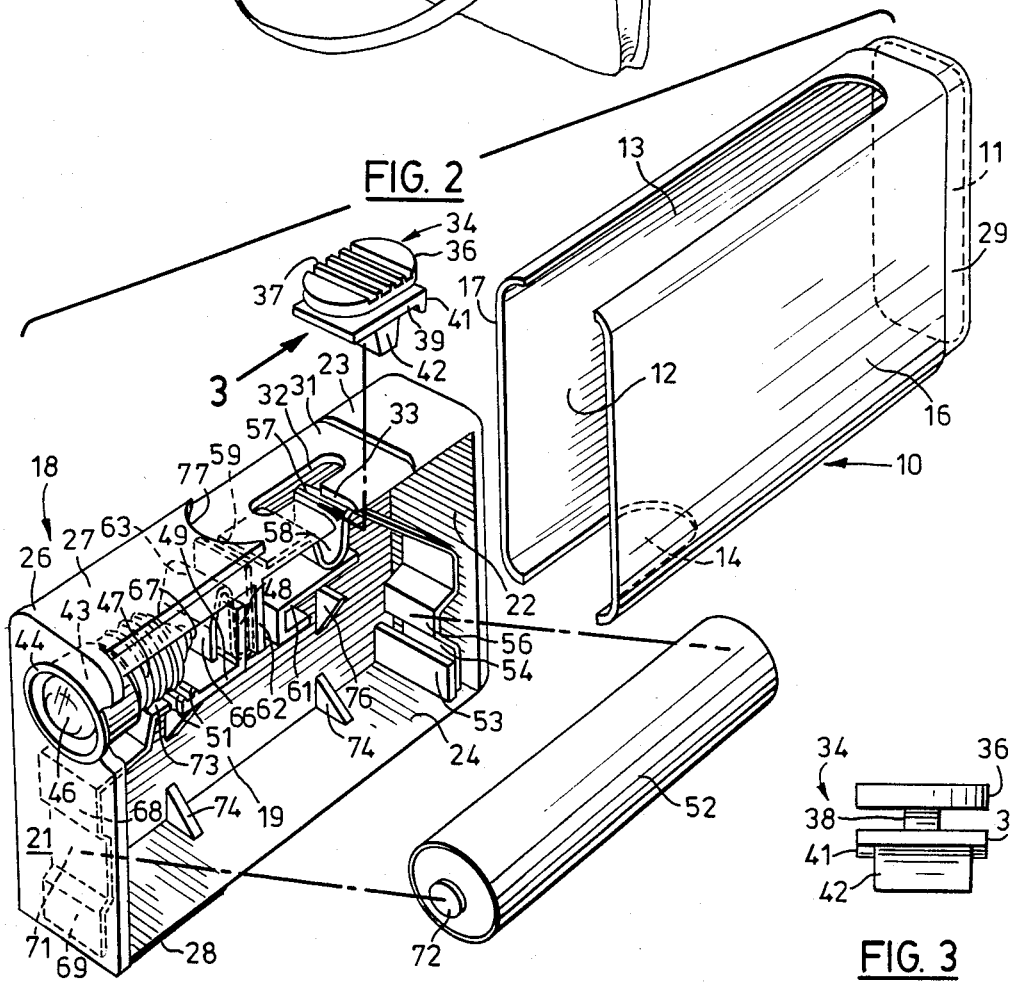
FIG. 3

SPOT LIGHT FOR HANDBAG AND LIKE RECEPTACLES

The present invention relates to a light for illuminating the interior of a handbag or like receptacle, such as a purse, pocketbook or briefcase.

The inventor is aware of various proposals for lamps intended to be mounted in the interior of a handbag or the like for illuminating the contents when the ambient light is poor. However, these have not been entirely satisfactory as they have not provided a strong illumination which can be used to illuminate substantially the entire contents of the handbag or other receptacle.

In the present invention, a source of illumination is provided having an opaque housing containing a single dry cell and a single light bulb arranged so that the assembly may be made relatively compact, whereby it will not take up much room within a small receptacle such as a lady's handbag. The light source is formed as a spotlight i.e. the light bulb is arranged to direct a spot of light through an opening in an end wall of the housing, whereby a relatively concentrated and bright light is obtained. The housing is provided with pivot means on one of its side walls about which, when the pivot means is adhered to an interior wall of the receptacle, the housing can be swung to move the spot of light arcuately, thus permitting substantially all areas of the interior of the receptacle to be brightly illuminated in turn, even though the power is of the relatively weak level which can be achieved with the conventional small dry cells and flashlight bulbs. The pivot means retain the housing stably in any selected angular position, so that the user has a free hand to retrieve an illuminated item, without needing to hold the light in its selected position.

Accordingly, the invention provides a spot light for illuminating the interior of a handbag or like receptacle, comprising a housing having opaque end walls, edge walls and side walls, a single dry cell in the housing between the end walls and alongside one edge wall, an opening in one end wall adjacent the edge wall opposite the dry cell, a reflector located in, and forming a bulb-receiving recess in, said opening, a light single bulb secured in the reflector to direct a spot of light from the opening, switch means operable from outside the housing to connect and disconnect the single dry cell and the bulb, and pivot means on one of the side walls comprising a circular socket and a circular disc nested in the socket and magnetically attracted into frictional contact therewith whereby the housing is pivotable arcuately about the pivot means and is supported thereby stably in a range of stable angular positions, one of the socket and disc being on said one side wall and the other having an adhesive backing for adhering it to the interior of a handbag or like receptacle.

The invention will now be more fully described, by way of example only, with reference to the accompanying drawings, in which:

FIG. 1 shows a lady's handbag and a spot light in accordance with the invention;

FIG. 2 is an exploded view of a spot light in accordance with the invention from a front side thereof;

FIG. 3 is an elevational view taken on the arrow 3 in FIG. 2 of the sliding switch of the device.

Figure 4:
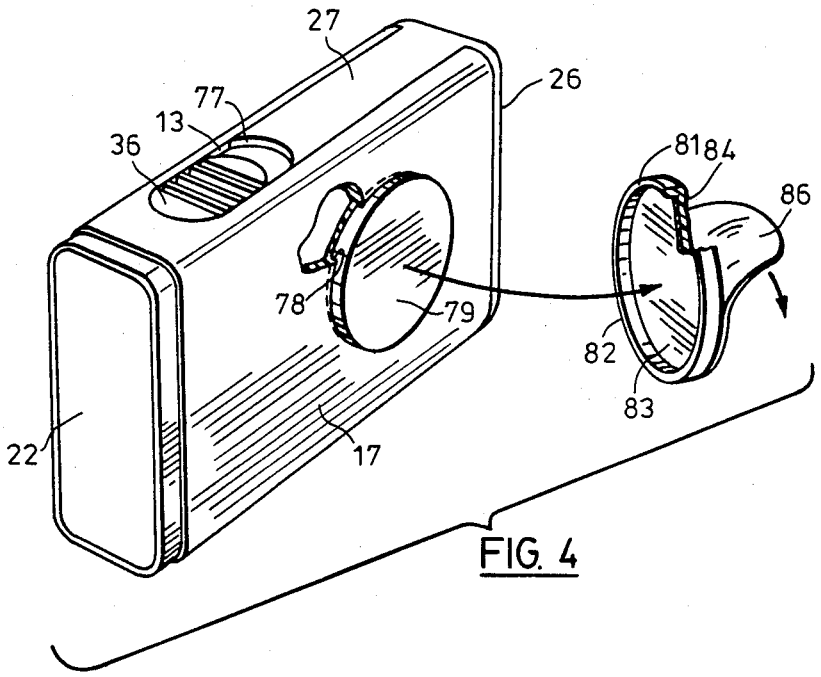
FIG. 4 is a perspective view from the rear side of the device showing the pivot means in more detail.

Referring to the drawings, the spot light device comprises a two-component housing which may be moulded of plastics material, comprising a generally tubular sleeve component 10, having openings 11 and 12 at opposite ends, a relatively long slot 13 in its upper edge wall and a relatively short slot 14 in its lower edge wall, and front and rear side walls 16 and 17.

The housing also comprises a tray component 18 having a rear side wall 19, front and rear end walls 21 and 22 and upper and lower edge walls 23 and 24. The front end wall 21 provides a rim portion 26 protruding beyond the exterior surfaces of the side wall 19 and edge walls 23 and 24, and which is formed flush with elongate raised portions 27 and 28 on the upper and lower edge walls 23 and 24, respectively. In the assembled condition, as shown in FIG. 4, wherein the tray component 18 is slid within the sleeve component 10, the portions 27 and 28 nest within the slots 13 and 14, respectively, while the inner edge of the rim portion 26 seats on the outer edge of the opening 12, the adjacent surfaces of all these portions being flush with one another, to provide a smooth exterior surface. Adjacent the opening 11, the sleeve component 10 may be formed with an inwardly stepped portion 29 defining an inner surface of reduced width and depth which grips in a friction fit over the edges of walls 19, 22, 23 and 24 of the tray component, thus retaining the latter firmly within the sleeve component in the assembled condition. The end wall 22 is, however, exposed through the opening 11, so that the tray component can be readily pushed out from within the sleeve component for the purposes of gaining access to the interior of the tray component.

A downwardly recessed portion 31 of the upper edge wall 23 has a longitudinally-extending slot 32, transversely from which a slot 33 extends to an edge of the wall 23. In the assembled condition, a slider switch member 34, as shown in FIGS. 2 and 3, is received in the slot 32. The switch member 34 has an upper finger-engaging portion 36, formed with ribs 37 on its upper side, and which is integrally joined through a narrow stem portion 38 to a lower plate portion 39 on the rear edge of which is moulded a transversely-extending downwardly-projecting rib 41. Adjacent the central portion of the plate 39 there is integrally moulded a downwardly-projecting transversely-extending tongue 42. In assembling the device, stem portion 38 is inserted through the transverse slot 33, and is received reciprocably within the longitudinally-extending slot 32, with the portion 31 being received snugly between the upper and the lower plate portions 36 and 39, so that the switch member 34 is retained against vertical movement.

An opening, e.g. a circular opening as shown, is formed through the end wall 21 of the tray component 18 adjacent the upper edge wall 23. A generally tubular reflector 43, e.g. of metal or metallized plastic, is received within the opening. The reflector 43 may have a laterally-extending rim 44 which is secured to the perimeter of the opening, e.g. by an adhesive. A conventional flashlight bulb 46 is disposed within the reflector 43. The bulb 46 has a threaded base 47. An L-section web, having a vertically extending portion 48 and a horizontally-extending portion 49 is moulded integrally with the rear wall 19. Adjacent its front end the upper surface of the horizontal portion 49 is formed with transversely-extending upwardly-projecting ribs 51. A tab portion (not shown in the drawings for the sake of clarity of illustration) is moulded integrally with the underside of the upper edge wall 23 and extends downwardly therefrom and is formed on its lower edge with transversely-extending downwardly projecting ribs overlying the ribs 51, and spaced therefrom by a distance approximating the diameter of the base 47 of the bulb 46. The bulb 46 is thus located within the housing in the position shown in FIG. 2 by having its threaded base 47 screwed into threaded engagement between the ribs 51 and the above-mentioned ribs on the downwardly-extending tab portion, and can be gripped at its base 47 or through the open end of the reflector 43 and unscrewed if it needs to be replaced.

The inner side of the tray component 18 is formed with further integrally-moulded projecting web portions which support and locate conductive resilient metal strips arranged for forming an electrical circuit between a dry cell 52 and the bulb 46. A plate portion 53, extending transversely from the side wall 19 adjacent the lower edge wall 24, locates the lower end of a metal strip 54. This includes an inwardly offset intermediate portion 56 which, when the cell 52 is inserted within the tray component 18 is contacted by and urged resiliently outwardly by the usually exposed metal rear end face of the cell 52, which forms one pole of the cell 52, thus establishing electrical contact between this pole and the metal of the strip 54. The upper portion of the strip 54 inclines upwardly forwardly to an upper bight portion 57 and a downwardly-projecting U-shape portion 58, from the opposite upper edge of which the strip extends horizontally to an end edge 59. A generally C-section web portion 61 is moulded integrally with the inner side of the wall 19 and extends transversely therefrom, and the U-shape portion 58 of the strip 54 engages and rides on the upper side of the web 61. A further web portion 62, moulded integrally with the underside of the upper edge wall 23, extends downwardly therefrom intermediate the vertical web portion 48 and the C-section web 61. A generally Z-section metal strip 63 has a lower bight portion extending under the lower edge of the web portion 62 and an upper bight portion extending over the web portion 48, with its limbs compressed resiliently between the C-section web 61 and the opposing face of the vertical web portion 48, and is thereby held by friction securely in the position shown. Between the downwardly-extending web 62 and the C-section web 61, the strip 63 extends upwardly approximately perpendicular to and at a small spacing from the end edge 59 of the strip 54, and terminates at an upper edge 64 adjacent the underside of the upper edge wall 23, and spaced a small distance above the end face 59. The opposite end of the strip 63 terminates in a generally vertically downwardly-extending end portion 66 which, when the bulb 46 is threaded into the housing, is engaged by and compressed resiliently rearwardly by the conventional tip terminal 67 at the rear of the base 47, thus forming electrical contact between the terminal 67 and the strip portion 66.

Adjacent the inner side of the front end wall 21, there is a further metal strip portion 68, which may be supported and located by having its lower end 69 engaged between the front end wall 21 and an integrally moulded plate portion (not shown) similar to the plate portion 53. The strip 68 includes an inwardly offset intermediate portion 71 which, when the cell 52 is inserted within the housing, is engaged and compressed resiliently forwardly by the small cylindrical metal terminal 72 on the front end face of the cell 52, forming the other pole of the cell, and thus establishing electrical contact between the portion 71 and the pole 72. The upper end of the strip 68 extends upwardly rearwardly to a generally horizontally-extending terminal portion 73 which is engaged by and pressed resiliently downwardly by the lower surface of the metal base 47 of the bulb, thus forming electrical contact with the base 47, which, as is conventional, forms the other terminal of the bulb 46.

In the assembled condition, the cell 52 is held frictionally by having its opposite end faces compressed resiliently between the inwardly offset portions 56 and 71, and is located by two longitudinally spaced sets of triangular shaped lugs, each comprising a lower lug 74 moulded integrally with and formed in the fashion of a fillet between the lower edge wall 24 and the side wall 19, and an upper lug 76 projecting from an intermediate portion of the rear wall 19. The lugs 74 and 76 provide inclining inner faces which engage snugly on the cylindrical side surface of the cell 52 wheh received in the housing. As will be appreciated, with the tray component 18 removed from the sleeve component 10, the cell may be removed and replaced.

In the assembled condition, the tongue 42 of the switch member 34 is received within the downwardly-projecting U-shape portion 58 of the strip 54. In a rearward or "off" position, as illustrated in FIG. 4, a convexly curved rear edge of the upper portion 36 is received in a complementarily curved rear edge of the slot 13 in the sleeve component 10. In this position, the rib 41 on the rear edge of the lower plate portion 39 of the switch member is disposed rearwardly of the upwardly-extending bight portion 57 of the strip 54, and rests lightly on the upper surface of the adjacent inclining portion of the strip 54. In use, when it is desired to switch the light on, the switch member 34 is pushed forwardly so that the tongue 42 engages the forward limb of the U-shape portion 58 of the strip 54 and urges the end edge 59 of the strip 54 into contact with the adjacent vertically-extending face of the Z-section metal strip 63, thus completing an electrical circuit extending from one pole 72 of the battery through the strip 68, the base 47 of the bulb, its filament, the tip terminal 67 of the bulb, the Z-section strip 63, and the strip 54, to the rear end face of the cell 52 forming its other electrical pole. The forward movement of the switch member 34 is limited by its convexly curved forward edge of its upper plate portion 36 engaging a correspondingly concavely curved recess 77 formed in the rear end of the raised portion 27. As the switch member 34 is moved to its forward or "on" position, the lower edge of the rib 41 rides over the upper surface of the bight portion 57 of the strip 54, compressing this resiliently downwardly, while at the same time the bight portion 57 is flexed slightly downwardly as a result of the forward movement of the U-shaped portion 58, until the rib 41 snaps forwardly into a position disposed within the limbs of the U-shaped portion 58, in which the rib 41 engages on the forward side of the bight portion 57. In this position, the forward side of the tongue 42 and the rear side of the rib 41 tend to splay the limbs of the U-shaped portion apart, thus holding the edge 59 in firm electrical contact with the strip 63. The snapping of rib 41 over the bight portion 57 provides a detent action which maintains the switch member 34 selectively in the rearward "off" and forward "on" positions, so that the bulb is kept switched on or off without the user having to keep a finger on the switch member 34. When the user desires to switch the light off, the switch member 34 is pushed rearwardly until the rib 41 snaps rearwardly over the upper surface of the bight member 57 while at the same time the tongue 42 disengages from the forward limb of the U-shape portion 58 of the strip 54, thus permitting the upper portion of the strip 54 to return to the relaxed position as shown in FIG. 2, wherein the end face 59 is spaced rearwardly from the Z-section strip 63, and interrupting the above-described circuit. It may be noted that the splaying and relaxing actions above referred to tend to scrape the edge 59 upwardly and downwardly on the adjacent vertical portion of the strip 63, thus keeping the contacting faces clean, so that a good electrical contact is preserved.

Desirably, the front surface of the bulb 46 is disposed at least slightly rearwardly of the outer side of the end wall 21. Desirably also, the tubular reflector 43 is of a frustro-conical form tapering rearwardly inwardly from the rim 44. With this arrangement, the bulb, when illuminated, provides a concentrated, rather narrow pencil of light, yielding an illuminated spot of relatively small diameter, but relatively high brightness, even though the intensity of the illumination from the bulb 46 is rather weak.

The housing of the light is provided with means for connecting it pivotally to the inner side of a handbag or other receptacle, with the pivot means providing some frictional or other resistance to rotation of the lamp about the pivotal axis, so that the light, once attached to the wall of the receptacle, can be turned through an arcuate path to illuminate the contents of the receptacle, but, when released, will be held steady in any selected angular position. Thus, after the user has located a particular item within the receptacle, the light will remain stably positioned casting light on the selected spot while the user retrieves the desired item from the receptacle.

In the preferred form, as best seen in FIG. 4, the rear wall 17 of the sleeve component 10 is moulded integrally with a circular recess 78 in which a disk magnet 79 is secured, e.g. by adhesive bonding. The magnet 79 extends a small distance laterally outwardly from the outer surface of the wall 17. A shallow cup-shaped socket 81 is provided, which forms a circular recess 82 complementary to the disk magnet 79. A thin sheet of magnetically attractable material, e.g. a disk of thin gauge steel 83, is secured to the base of the recess 82, e.g. by adhesive, and means are provided on the outer side of the socket 81 for securing it to the inner wall of a handbag or like receptacle. In the preferred form, the rear face of the socket 81 is coated with a layer of tacky pressure-sensitive adhesive 84 which is normally covered with a peelable release-coated disk 86 of paper or like sheet material. In use, the peelable disk 86 is removed, and the side of the socket coated with the adhesive 84 is pressed firmly into contact with the inner wall of the receptacle, e.g. the inner wall 87 of a handbag 88 as illustrated in FIG. 1. The light is positioned with the magnetic disk received in the socket 81, whereby, with the light switched on, the device can be pivoted upwardly and downwardly about the axis of the disk 79 and socket 81 to illuminate the contents of the handbag as indicated by the double-ended arrow in FIG. 1. Desirably, as shown in FIG. 1, with a handbag or other receptacle, such as a briefcase, which is normally held in the open position with an opening at the top defined by a front side wall 89 and a rear side wall 91, the socket 81 or other pivotal connection means will be attached to an upper corner of the inner side of one side wall, e.g. the inner side wall 87, so that the light is readily accessible on opening the receptacle, and, when arranged as shown, with the end wall 21, in which the bulb 46 is disposed, facing inwardly to the interior of the receptacle, can be pivoted between positions permitting substantially the entire contents of the receptacle to be illuminated. Because of the magnetic attraction, there is a frictional force between the contacting surfaces of the magnet 79 and disk 83 which resists any moment due to the weight of the light tending to rotate it about its pivot axis, so that after the user has illuminated a selected area of the interior of the receptacle, the user has a free hand to retrieve any selected illuminated item, since the light is held stable in its adjusted angular position, and does not require the user's hand to maintain its position.

As will be appreciated, other forms of connection can be used which will connect the housing of the light pivotally to the interior wall of a bag or other receptacle and which will maintain the light stable in a selected angular position through frictional or other resistance to turning movement. Desirably, however, the connection is releasable, thus permitting the light to be removed, so that it can be used outside the bag or other receptacle. For example, a rotatable snap-fit coupling may be employed, or the disk 83 may be secured on the housing 10 within a circular recessed socket, and the disk magnet 79 may be adapted to be secured to the inner wall of the receptacle. The arrangement as illustrated, however, provides the advantage that the magnetic disk 79 may be used to support the light temporarily on any convenient adjacent magnetically attractable metal surface, for example a door frame or the like, on occasions when it is desired to use the light outside the bag or other receptacle. The arrangement as illustrated, wherein the dry cell 52 is supported along one edge wall of the housing and the bulb is located in an opening in an end wall adjacent an opposite edge wall of the housing, permits the light to be made very compactly. Merely by way of example, it may be mentioned that the light in the assembled condition may be about 2 inches in length, about $\frac{5}{8}$ inch in thickness, and about $1\frac{1}{4}$ inches in height. This light can therefore be accommodated in quite small receptacles, e.g. small handbags, without significantly reducing the capacity of the bag.

I claim:

1. A spot light for illuminating the interior of a handbag or like receptacle, comprising a housing having opaque end walls, edge walls and side walls, a single dry cell received in the housing between the end walls and the alongside one edge wall, an opening in one end wall adjacent the edge wall opposite the dry cell, a reflector located in, and forming a bulb-receiving recess in, said opening, a single light bulb secured in the reflector to direct a narrow spot of light from the opening, switch means operable from outside the housing to connect and disconnect said single dry cell and the bulb, and pivot means on one of the side walls, comprising a circular socket and a circular disc nested in the socket and magnetically attracted into frictional contact therewith, whereby the housing is pivotable arcuately about the pivot means and is supported thereby stably in a range of stable angular positions, one of the socket and disc being on said one side wall, and the other of the socket and disc having an adhesive backing for adhering it to the interior of a handbag or like receptacle.

2. A spot light as claimed in claim 1, wherein said adhesive backing is covered by a removable protector.

3. A spot light as claimed in claim 2, wherein the disc is magnetic and is affixed to said one side wall.

4. A spot light as claimed in claim 1 wherein the reflector comprises a frustro conical portion extending around the bulb.

5. A spot light as claimed in claim 1 including detent means maintaining the switch means selectively in positions completing a circuit between the bulb and dry cell and interrupting said circuit, respectively.

6. A spot light as claimed in claim 5 wherein the switch means comprise a slider member reciprocable on the housing, a projection on the inner side of the slider member, and said detent means comprise a bight portion on a resilient metal strip comprising part of said circuit, and the projection riding over and snapping between positions on opposite sides of said bight portion.

7. A spot light as claimed in claim 1 wherein the switch means comprise resilient metal strips disposed between the bulb and the dry cell, including a first strip having a portion extending approximately perpendicularly to and normally at a spacing from an end edge of a second strip, and a switch member movable to move said end edge into scraping contact with said portion.

8. A spot light as claimed in claim 1, wherein the housing comprises a sleeve component slidable over a tray component that holds the dry cell, bulb and switch means, whereby removal of the sleeve component enables insertion and removal of the dry cell and bulb into and from the tray component.

9. In combination a handbag or like receptacle having side walls defining an opening at the top and a spot light as claimed in claim 1 attached through said pivot means to an upper corner of one of said receptacle side walls with said one end wall of the spot light facing toward the interior of the receptacle, whereby said spot of light can be swung arcuately through the interior of the receptacle.

* * * * *